US007841803B2

(12) United States Patent
Öberg et al.

(10) Patent No.: US 7,841,803 B2
(45) Date of Patent: Nov. 30, 2010

(54) DEVICE FOR ROCK BOLTING AND FOR AUTOMIZED ROCK BOLTING AND ROCK BOLTING METHOD

(75) Inventors: Fredrik Öberg, Örebro (SE); Per Jonson, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 182 days.

(21) Appl. No.: 10/555,031

(22) PCT Filed: May 12, 2004

(86) PCT No.: PCT/SE2004/000730

§ 371 (c)(1),
(2), (4) Date: Oct. 27, 2005

(87) PCT Pub. No.: WO2004/099568

PCT Pub. Date: Nov. 18, 2004

(65) Prior Publication Data

US 2006/0278414 A1 Dec. 14, 2006

(30) Foreign Application Priority Data

May 12, 2003 (SE) ..... 0301375

(51) Int. Cl.
*E21D 20/02* (2006.01)
*E02D 5/74* (2006.01)

(52) U.S. Cl. ..... 405/259.1; 405/266; 405/303; 52/158; 173/1

(58) Field of Classification Search ..... 405/259.5, 405/258.1, 259.1, 266, 303; 52/155, 158; 173/1; 227/14
See application file for complete search history.

(56) References Cited

U.S. PATENT DOCUMENTS

| | | | | | |
|---|---|---|---|---|---|
| 3,212,269 | A | * | 10/1965 | Olsen | 405/259.5 |
| 3,494,133 | A | * | 2/1970 | Ahlgren et al. | 405/259.5 |
| 3,851,560 | A | * | 12/1974 | Yago | 411/30 |
| 3,861,155 | A | * | 1/1975 | Steinberg et al. | 405/259.5 |
| 4,055,051 | A | * | 10/1977 | Finney | 405/259.6 |
| 4,127,000 | A | * | 11/1978 | Montgomery et al. | 405/259.6 |
| 4,398,850 | A | * | 8/1983 | Talvensaari | 405/259.6 |

(Continued)

FOREIGN PATENT DOCUMENTS

DE 8401490 4/1984

(Continued)

OTHER PUBLICATIONS

Prospekt "Hydraulik Hammerbohmaschinen" der Fa. Bohler Drucklegung 4.89.

*Primary Examiner*—Tara Mayo-Pinnock
(74) *Attorney, Agent, or Firm*—Mark P. Stone

(57) ABSTRACT

A device for rock bolting with an adapter device (10) for connection of a drilling machine (3) to a self drilling rock bolt (7), in which the adapter device has an adapter element (14) which is sealingly surrounded by a swivel sleeve (13) for connection to one or more external source for flushing medium (8) and bolt grouting medium (9), and in which the adapter element has a thread for connecting to a corresponding thread on the rock bolt (7), and an integral connection portion for connection to the drilling machine (3).

22 Claims, 2 Drawing Sheets

U.S. PATENT DOCUMENTS

| | | | | |
|---|---|---|---|---|
| 4,744,699 | A * | 5/1988 | Price et al. | 405/259.5 |
| 5,044,832 | A * | 9/1991 | Gruber | 405/259.5 |
| 5,951,208 | A * | 9/1999 | Wilson et al. | 405/259.6 |
| 6,447,210 | B1 * | 9/2002 | Coombs | 405/259.5 |
| 6,591,919 | B1 * | 7/2003 | Herrmann | 173/42 |
| 6,648,557 | B1 * | 11/2003 | Morrow et al. | 405/259.1 |
| 6,736,225 | B2 * | 5/2004 | Pierce | 175/58 |
| 6,793,445 | B1 * | 9/2004 | Charlton et al. | 405/259.5 |

FOREIGN PATENT DOCUMENTS

| | | |
|---|---|---|
| DE | 9406389 | 2/1995 |
| DE | 4432472 | 3/1996 |
| DE | 19607988 | 9/1997 |
| DE | 19957903 | 6/2001 |
| EP | 1077305 | 2/2001 |
| GB | 2169050 | 7/1986 |
| GB | 2206172 | 12/1988 |
| JP | 3101217 | 7/1998 |
| JP | 2001-262993 | 9/2001 |
| WO | 0060215 | 10/2000 |

* cited by examiner

DEVICE FOR ROCK BOLTING AND FOR AUTOMIZED ROCK BOLTING AND ROCK BOLTING METHOD

FIELD OF THE INVENTION

The invention concerns a device for rock bolting and a device for automatized rock bolting. The invention also concerns a method for rock bolting.

DESCRIPTION OF BACKGROUND ART

The use of self-drilling rock bolts provides a rational procedure since the bore hole, into which the rock bolt is intended to bee inserted, is formed with the rock bolt itself as a drilling tool. After the drilling step a bolt grouting medium such as cement is injected into the bore hole for grouting the rock bolt for rock reinforcement purposes etc.

During the boring step the drilling area is flushed with pressurized air or with a flushing fluid which is alternatively flushed during the drilling step as a thin flowing cement which also serves for grouting purposes.

Such flushing can be continuous and results in a better penetration of the cement into the rock surrounding the bore hole and consequently better anchoring of the bolt.

A previously known device for rock bolting includes a swivel device which is screwed onto the neck adapter of the drilling machine. The other end of the swivel device provides a thread for receiving a threaded end of a self drilling rock bolt.

This previously known device is used for manually controlled rock bolting and requires monitoring by an operator when loosening the drilled-in rock bolt from the swivel device.

AIM AND MOST IMPORTANT FEATURES OF THE INVENTION

It is an aim with this invention to provide an improvement of the device according to the background art and in particular to provide a device which allows entirely automatized rock bolting including jointing of a self drilling rock bolt.

These aims are obtained through the features of the invention disclosed herein.

Hereby is achieved that unfastening of the adapter element will occur in a defined manner between that element and the rock bolting question or the extension rod. This is a considerable advantage, since hereby the unfastening procedure is essentially simplified compared to the background art and since use with automatized rock bolting is allowed.

A corresponding device for automatized rock bolting is disclosed herein, wherein the corresponding advantages are achieved.

Also the method disclosed herein brings about the corresponding advantages.

Further features and advantages will be evident from the following.

BRIEF DESCRIPTION OF DRAWINGS

The invention will now be described to the background of an embodiment and with reference to annexed drawings, wherein.

DESCRIPTION OF EMBODIMENT

Figure 1:
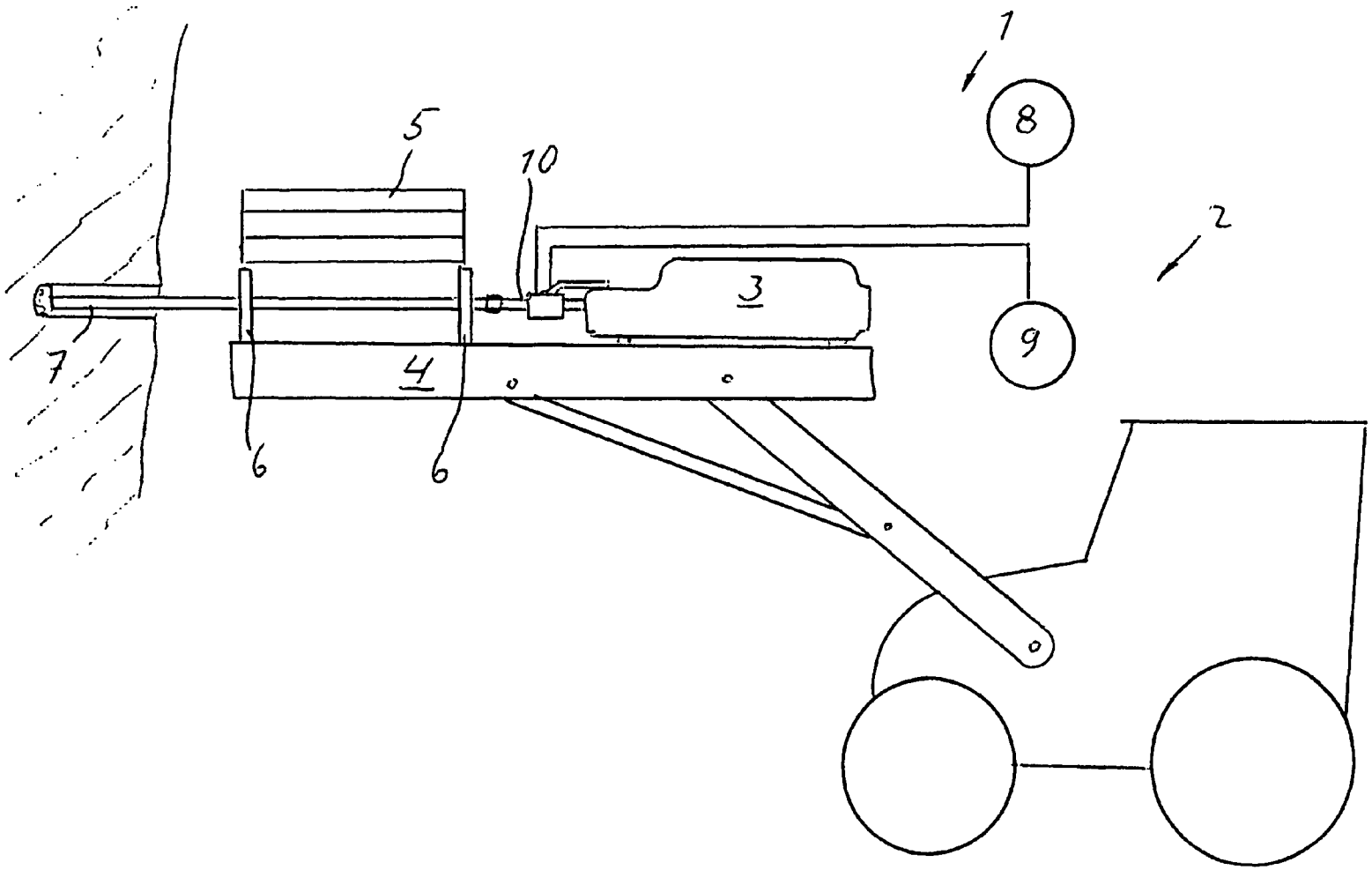
FIG. 1 diagrammatically shows a device for automatized rock bolting including a drill rig.

A device 1 for automatized rock bolting with self drilling rock bolts includes a drilling rig 2 having means for supporting a conventional drilling machine 3 which is reciprocally movable on a longitudinal guide 4. A storage facility for rock bolts and/or jointing rods for rock bolts is indicated with 5.

Along a guide 4 there are provided drills supports 6 for supporting a self drilling rock bolt 7 with possible thread joined jointing rod in the drilling process.

The storage facility and the drill supports functions in general like ones that are provided in conventional devices for automatized drilling and are therefore not described more detailed here.

A source for flushing medium 8 is over conduits and an adapter device 10 arranged to communicate with the self drilling rock bolt 7 for flushing during drilling a bore hole for the rock bolt at a determined location into the rock structure to be reinforced.

A source for bolt grouting medium 9 for injecting cement or corresponding grouting medium is also arranged to communicate with the rock bolt 7 over the adapter device 10. This can be accomplished by feeding this medium continuously during the drilling process as flushing medium/injection medium or after termination of the drilling process as conventional grouting medium.

Figure 2:
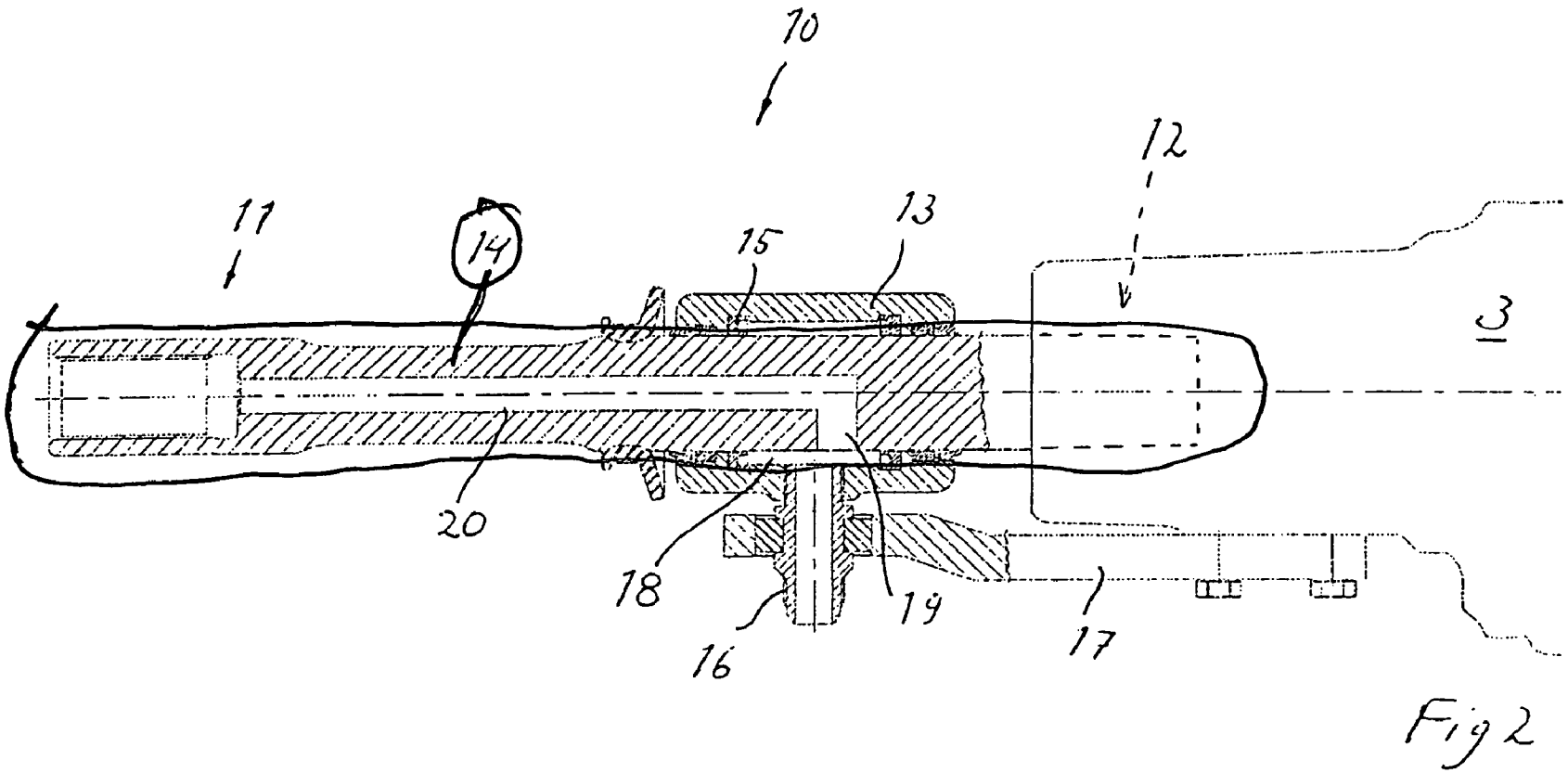
FIG. 2 shows in greater detail a device for rock bolting according to the invention.
Figure 2:
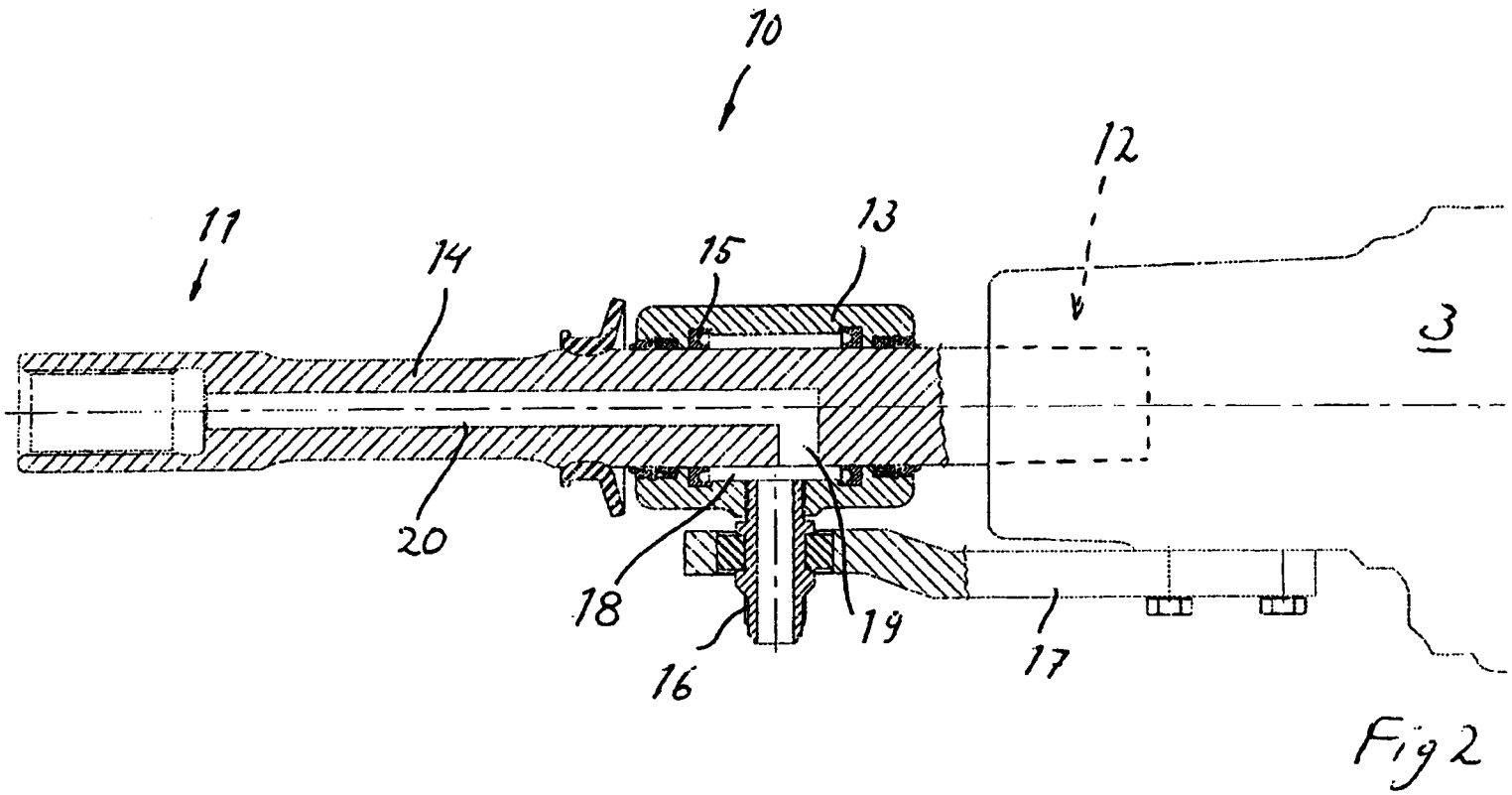

The device for rock bolting 10 is shown in more detail on FIG. 2 as an adapter device 10, whereby is evident that the device includes a longitudinal adapter element 14 having a distal end 11 for connection to a self drilling rock bolt and a proximal end 12 comprising an integral connection portion of the adapter element 14 for cooperation with a conventional rock drilling machine 3.

According to the invention is hereby intended that the adapter element including the connection portion is comprised of one single integral element which is manufactured in one piece. This results in that this element withstands the loads that the shock wave causes in percussion drilling. Hereby a real possibility of automatizing the bolting process is provided.

A swivel sleeve 13 is arranged surrounding a portion of the adapter element 14, rotationally fixed, fastened to the drilling machine 3 over a rotation preventing arm 17. This element is on the one hand fastened to the drilling machine 3 and provides on the other hand means in form of a ring-shaped end portion for cooperation with a connection nipple 16 extending radially from the swivel sleeve 13. The swivel sleeve is thereby arranged non-rotational with respect of the drilling machine.

The connection nipple 16 is intended to be connected to either of the sources 8 or 9 in FIG. 1 for flushing and injection of grouting medium respectively. As an alternative, there could of course be arranged two connection nipples, one for communication with each source.

The swivel sleeve 13 provides sealings 15 on each side of an annular space 18, surrounding a portion of the adapter element 14, wherein a radial channel 19 (can be more than one) debouches. The channel 19 connects the space 18 with an axial channel 20 which debouches in the inside of a recessed portion for a self drilling rock bolt at the distal end of the adapter element 14. This way medias from the sources 8 and 9 in FIG. 1 will be transmitted to a rock bolt which is inserted into the recessed portion.

As illustrated by FIG. 2, in operation, the swivel sleeve (13) surrounds the adapter element (14) at a position outside of the drilling machine (3).

A method for rock bolting according to the invention is as follows:

Step 1

In a recessed portion in an adapter device which is inserted into a drilling machine there is connected a self drilling rock bolt to be driven-in and anchored.

Step 2

The drilling step proceeds as usual with the difference that flushing of the area of a drill bit of the self drilling rock bolt is not flushed over the drilling machine itself but over the adapter device, which is either connected to a flushing medium source or to a light flowing cement which simultaneously flushes and grouts.

Step 3

After having driven-in the self drilling rock bolt passed a front drill support on the drilling machine guide, the rotational direction of the drilling machine 3 is reversed for loosening the thread engagement between the female thread on the distal end of the adapter element and the rock bolt. The rock bolt is now free to be used as rock reinforcement or to be jointed with a jointing rod and be drilled-in further.

Step 4

The drilling machine 3 is reversed in order to alternatively be in a position to cooperate with a jointing rod if this is necessary for insertion of a sufficiently long rock bolt, whereby after having been driven-in, cement is injected in a manner indicated above. This injection step is also applicable in case the rock bolt was ready to use already after step 2 and cement (or the like) has not been used for flushing.

The advantages achieved through the invention could be summarised as follows:

No loose coupling has to be handled since the rock bolt will always become unfastened from the adapter element because of the presence of only one thread joint.

Continuous cement injection can be made during drilling.

The bolt is installed in one single operation since injection of the cement does not require connecting of a separate pump to the bolt.

Completely mechanised/automatized installation of self drilling bolts can be realized according to the invention and with the aid of a bolt storage facility.

The invention claimed is:

1. An adapter device (1) for connecting a drilling machine (3) to a self drilling rock bolt (7) for rock bolting, said adapter device including an adapter element (14) which is sealingly surrounded by a swivel sleeve (13) that is arranged for connection of an axial channel through the adapter device (20), which in operation cooperates with an axial flushing channel in the rock bolt, to at least one external source for flushing medium (8) and bolt grouting medium (9), wherein the adapter element (14) at a distal end (11) includes a thread for connecting to a corresponding thread on the rock bolt (7), wherein the adapter element (14) at a proximal end (12) includes an integral connection portion for connection to the drilling machine (3), the adapter element and the connection portion thereof being integrally formed as one single element in one piece; and means for maintaining the swivel sleeve (13) surrounding the adapter element (14) at a position outside of said drilling machine (3) during operation of said adapter device.

2. The adapter device according to claim 1, wherein the rock bolt (7) comprises an external thread and the adapter (14) comprises a threaded bore for receivingly engaging the corresponding external thread of the rock bolt (7).

3. The adapter device according to claim 2, wherein the swivel sleeve (13) has an essentially radially extending connection nipple (16), for flushing medium, bolt grouting medium, which is arranged for cooperation with a rotational preventing arm (17), which is arranged to be fastened to the drilling machine.

4. The adapter device according to claim 3, wherein it is arranged to be used in automatized rock bolting, wherein the adapter element has a length that exceeds a distance between the drilling machine (3) in its most advanced position and a front drill support (6) for a rock bolt (7) to be driven in.

5. The adapter device (1) for automatized rock bolting with self drilling rock bolts and including a drilling machine (3) which is reciprocal on a guide (4), a rock bolt storage facility (5) for self drilling rock bolts (7), at least one external source for flushing medium (8) and bolt grouting medium (9), bore support for a rock bolt which is in a position to be driven in, including a device for rock bolting according to claim 4.

6. The adapter device (1) for automatized rock bolting with self drilling rock bolts and including a drilling machine (3) which is reciprocal on a guide (4), a rock bolt storage facility (5) for self drilling rock bolts (7), at least one external source for flushing medium (8) and bolt grouting medium (9), bore support for a rock bolt which is in a position to be driven in, including a device for rock bolting according to claim 3.

7. The adapter device according to claim 2, wherein it is arranged to be used in automatized rock bolting, wherein the adapter element has a length that exceeds a distance between the drilling machine (3) in its most advanced position and a front drill support (6) for a rock bolt (7) to be driven in.

8. The adapter device (1) for automatized rock bolting with self drilling rock bolts and including a drilling machine (3) which is reciprocal on a guide (4), a rock bolt storage facility (5) for self drilling rock bolts (7), at least one external source for flushing medium (8) and bolt grouting medium (9), bore support for a rock bolt which is in a position to be driven in, including a device for rock bolting according to claim 7.

9. The adapter device (1) for automatized rock bolting with self drilling rock bolts and including a drilling machine (3) which is reciprocal on a guide (4), a rock bolt storage facility (5) for self drilling rock bolts (7), at least one external source for flushing medium (8) and bolt grouting medium (9), bore support for a rock bolt which is in a position to be driven in, including a device for rock bolting according to claim 2.

10. A drilling machine comprising an adapter device as claimed in claim 2.

11. The adapter device according to claim 1, wherein the swivel sleeve (13) has an essentially radially extending connection nipple (16), for flushing medium, bolt grouting medium, which is arranged for cooperation with a rotational preventing arm (17), which is arranged to be fastened to the drilling machine.

12. The adapter device according to claim 11, wherein it is arranged to be used in automatized rock bolting, wherein the adapter element has a length that exceeds a distance between the drilling machine (3) in its most advanced position and a front drill support (6) for a rock bolt (7) to be driven in.

13. The adapter device (1) for automatized rock bolting with self drilling rock bolts and including a drilling machine (3) which is reciprocal on a guide (4), a rock bolt storage facility (5) for self drilling rock bolts (7), at least one external source for flushing medium (8) and bolt grouting medium (9), bore support for a rock bolt which is in a position to be driven in, including a device for rock bolting according to claim 12.

14. The adapter device (1) for automatized rock bolting with self drilling rock bolts and including a drilling machine (3) which is reciprocal on a guide (4), a rock bolt storage facility (5) for self drilling rock bolts (7), at least one external source for flushing medium (8) and bolt grouting medium (9), bore support for a rock bolt which is in a position to be driven in, including a device for rock bolting according to claim 11.

15. A drilling machine comprising an adapter device as claimed in claim 11.

16. The adapter device according to claim 1, wherein said adapter device is arranged to be used in automatized rock bolting, wherein the adapter element has a length that exceeds a distance between the drilling machine (3) in its most advanced position and a front drill support (6) for a rock bolt (7) to be driven in.

17. The adapter device (1) for automatized rock bolting with self drilling rock bolts and including a drilling machine (3) which is reciprocal on a guide (4), a rock bolt storage facility (5) for self drilling rock bolts (7), at least one external source for flushing medium (8) and bolt grouting medium (9), bore support for a rock bolt which is in a position to be driven in, including a device for rock bolting according to claim 16.

18. A drilling machine comprising an adapter device as claimed in claim 16.

19. The adapter device (1) for automatized rock bolting with self drilling rock bolts and including a drilling machine (3) which is reciprocal on a guide (4), a rock bolt storage facility (5) for self drilling rock bolts (7), at least one external source, for flushing medium (8) and bolt grouting medium (9), bore support for a rock bolt which is in a position to be driven in, including a device for rock bolting according to claim 1.

20. A drilling machine comprising an adapter device as claimed in claim 19.

21. A drilling machine comprising an adapter device as claimed in claim 1.

22. A method for rock bolting with self drilling rock bolts, wherein a drilling machine (3) drives a rock bolt during simultaneous flushing with a flushing medium and injection with bolt grouting medium respectively over an adapter device (10), which includes an adapter element (14) that is sealingly surrounded by a swivel sleeve (13), said swivel sleeve (13), in operation, surrounding said adapter element (14) at a position outside of said drilling machine (3), wherein the adapter device (10) is threaded to the rock bolt to be driven in, wherein the adapter element (14) is connected to the drilling machine (3) by means of an integral connection portion at a proximal end (12), the adapter element and said connection portion thereof being integrally formed as one single element in one piece; and wherein the adapter device is unfastened from its engagement with the rock bolt by rotationally reversing the drilling machine.

* * * * *

UNITED STATES PATENT AND TRADEMARK OFFICE

CERTIFICATE OF CORRECTION

PATENT NO. : 7,841,803 B2
APPLICATION NO. : 10/555031
DATED : November 30, 2010
INVENTOR(S) : Fredrik Öberg and Per Jonson It is certified that error appears in the above-identified patent and that said Letters Patent is hereby corrected as shown below:

The title page showing the illustrative figure should be deleted to be replaced with the attached title page.

The drawing sheet, consisting of Fig. 2, should be deleted to be replaced with the drawing sheet, consisting of Fig. 2, as shown on the attached page.

Signed and Sealed this
Eighth Day of March, 2011

David J. Kappos

David J. Kappos
*Director of the United States Patent and Trademark Office*

(12) United States Patent
Öberg et al.

(10) Patent No.: US 7,841,803 B2
(45) Date of Patent: Nov. 30, 2010

(54) DEVICE FOR ROCK BOLTING AND FOR AUTOMIZED ROCK BOLTING AND ROCK BOLTING METHOD

(75) Inventors: Fredrik Öberg, Örebro (SE); Per Jonson, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 182 days.

(21) Appl. No.: 10/555,031

(22) PCT Filed: May 12, 2004

(86) PCT No.: PCT/SE2004/000730

§ 371 (c)(1), (2), (4) Date: Oct. 27, 2005

(87) PCT Pub. No.: WO2004/099568

PCT Pub. Date: Nov. 18, 2004

(65) Prior Publication Data

US 2006/0278414 A1 Dec. 14, 2006

(30) Foreign Application Priority Data

May 12, 2003 (SE) ..... 0301375

(51) Int. Cl.
*E21D 20/02* (2006.01)
*E02D 5/74* (2006.01)

(52) U.S. Cl. ..... 405/259.1; 405/266; 405/303; 52/158; 173/1

(58) Field of Classification Search ..... 405/259.5, 405/258.1, 259.1, 266, 303; 52/155, 158; 173/1; 227/14
See application file for complete search history.

(56) References Cited

U.S. PATENT DOCUMENTS

| | | | | | |
|---|---|---|---|---|---|
| 3,212,269 | A | * | 10/1965 | Olsen | 405/259.5 |
| 3,494,133 | A | * | 2/1970 | Ahlgren et al. | 405/259.5 |
| 3,851,560 | A | * | 12/1974 | Yago | 411/30 |
| 3,861,155 | A | * | 1/1975 | Steinberg et al. | 405/259.5 |
| 4,055,051 | A | * | 10/1977 | Finney | 405/259.6 |
| 4,127,000 | A | * | 11/1978 | Montgomery et al. | 405/259.6 |
| 4,398,850 | A | * | 8/1983 | Talvensaari | 405/259.6 |

(Continued)

FOREIGN PATENT DOCUMENTS

DE 8401490 4/1984

(Continued)

OTHER PUBLICATIONS

Prospekt "Hydraulik Hammerbohmaschinen" der Fa. Bohler Drucklegung 4.89.

*Primary Examiner*—Tara Mayo-Pinnock
(74) *Attorney, Agent, or Firm*—Mark P. Stone

(57) ABSTRACT

A device for rock bolting with an adapter device (10) for connection of a drilling machine (3) to a self drilling rock bolt (7), in which the adapter device has an adapter element (14) which is sealingly surrounded by a swivel sleeve (13) for connection to one or more external source for flushing medium (8) and bolt grouting medium (9), and in which the adapter element has a thread for connecting to a corresponding thread on the rock bolt (7), and an integral connection portion for connection to the drilling machine (3).

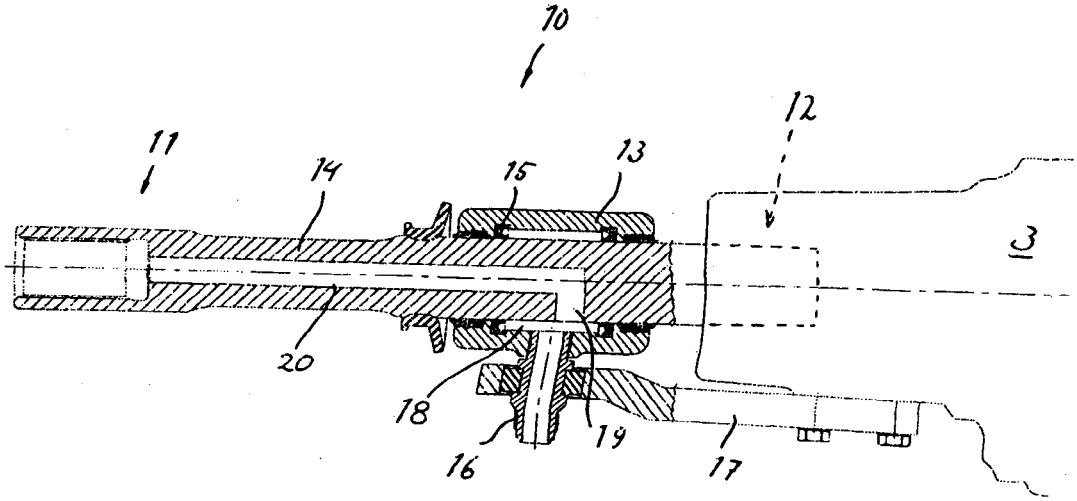

22 Claims, 2 Drawing Sheets